US006095527A

United States Patent [19]

Robertson

[11] Patent Number: 6,095,527

[45] Date of Patent: Aug. 1, 2000

[54] GRABBING REFLEX GAME

[76] Inventor: John Robertson, 7 Lossie Street Riddrie, Glasgow, Scotland G33 2AN, United Kingdom

[21] Appl. No.: 09/314,901

[22] Filed: May 20, 1999

[51] Int. Cl.[7] ..... A63F 9/00

[52] U.S. Cl. ..... 273/445; 273/447

[58] Field of Search ..... 273/445, 447

[56] References Cited

U.S. PATENT DOCUMENTS

| | | | |
|---|---|---|---|
| 4,261,563 | 4/1981 | Goldfarb | 273/445 X |
| 4,266,767 | 5/1981 | Spring | 273/447 |
| 4,310,156 | 1/1982 | Kulesza et al. | 273/447 |
| 4,919,429 | 4/1990 | Wittingslow, Jr. | 273/447 |
| 5,702,108 | 12/1997 | Todokoro | 273/447 |
| 5,794,937 | 8/1998 | Robbs, III | 273/447 |

*Primary Examiner*—Raleigh W. Chiu

[57] ABSTRACT

A game for grabbing a playing marker before an opponent does to score a point. The game includes a playing mat with a pair of end edges and a pair of side edges. The playing mat also has a center point and a pair of base lines extending between the side edges of the playing mat. The center point is interposed between the base lines. Each of the base lines defines a base region extending from the respective base line and an adjacent associated end edge of the playing mat resting the playing mat. A marker piece is positioned on the center point of the playing mat. A first player places a hand on the playing mat in a first of the base regions and a second player places a hand on the playing mat in a second of the base regions. After a start command is issued the first and second players grab for the marker piece with the player grabbing the marker piece scoring a point.

12 Claims, 2 Drawing Sheets

GRABBING REFLEX GAME

BACKGROUND OF THE INVENTION

1. Field of the Invention

The present invention relates to reflex games and more particularly pertains to a new game for grabbing a playing marker before an opponent does to score a point.

2. Description of the Prior Art

The use of reflex games is known in the prior art. More specifically, reflex games heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U. S. Pat. No. 3,583,701; U.S. Pat. No. 4,919,429; U.S. Pat. No. 4,310,156; U.S. Pat. No. 2,587,381; U.S. Pat. No. 2,995,371; and U.S. Pat. No. Des. 373,148.

While these devices fulfill their respective, particular objectives and requirements, the aforementioned patents do not disclose a new game. The inventive device includes a playing mat with a pair of end edges and a pair of side edges. The playing mat also has a center point and a pair of base lines extending between the side edges of the playing mat. The center point is interposed between the base lines. Each of the base lines defines a base region extending from the respective base line and an adjacent associated end edge of the playing mat. resting the playing mat. A marker piece is positioned on the center point of the playing mat. A first player places a hand on the playing mat in a first of the base regions and a second player places a hand on the playing mat in a second of the base regions. After a start command is issued the first and second players grab for the marker piece with the player grabbing the marker piece scoring a point.

In these respects, the game according to the present invention substantially departs from the conventional concepts and designs of the prior art, and in so doing provides an apparatus primarily developed for the purpose of grabbing a playing marker before an opponent does to score a point.

SUMMARY OF THE INVENTION

In view of the foregoing disadvantages inherent in the known types of reflex games now present in the prior art, the present invention provides a new game construction wherein the same can be utilized for grabbing a playing marker before an opponent does to score a point.

The general purpose of the present invention, which will be described subsequently in greater detail, is to provide a new game apparatus and method which has many of the advantages of the reflex games mentioned heretofore and many novel features that result in a new game which is not anticipated, rendered obvious, suggested, or even implied by any of the prior art reflex games, either alone or in any combination thereof.

To attain this, the present invention generally comprises a playing mat with a pair of end edges and a pair of side edges. The playing mat also has a center point and a pair of base lines extending between the side edges of the playing mat. The center point is interposed between the base lines. Each of the base lines defines a base region extending from the respective base line and an adjacent associated end edge of the playing mat. resting the playing mat. A marker piece is positioned on the center point of the playing mat. A first player places a hand on the playing mat in a first of the base regions and a second player places a hand on the playing mat in a second of the base regions. After a start command is issued the first and second players grab for the marker piece with the player grabbing the marker piece scoring a point.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new game apparatus and method which has many of the advantages of the reflex games mentioned heretofore and many novel features that result in a new game which is not anticipated, rendered obvious, suggested, or even implied by any of the prior art reflex games, either alone or in any combination thereof.

It is another object of the present invention to provide a new game which may be easily and efficiently manufactured and marketed.

It is a further object of the present invention to provide a new game which is of a durable and reliable construction.

An even further object of the present invention is to provide a new game which is susceptible of a low cost of manufacture with regard to both materials and labor, and which accordingly is then susceptible of low prices of sale to the consuming public, thereby making such game economically available to the buying public.

Still yet another object of the present invention is to provide a new game which provides in the apparatuses and methods of the prior art some of the advantages thereof, while simultaneously overcoming some of the disadvantages normally associated therewith.

Still another object of the present invention is to provide a new game for grabbing a playing marker before an opponent does to score a point.

Yet another object of the present invention is to provide a new game which includes a playing mat with a pair of end edges and a pair of side edges. The playing mat also has a center point and a pair of base lines extending between the side edges of the playing mat. The center point is interposed between the base lines. Each of the base lines defines a base region extending from the respective base line and an adjacent associated end edge of the playing mat. resting the playing mat. A marker piece is positioned on the center point of the playing mat. A first player places a hand on the playing mat in a first of the base regions and a second player places a hand on the playing mat in a second of the base regions. After a start command is issued the first and second players grab for the marker piece with the player grabbing the marker piece scoring a point.

Still yet another object of the present invention is to provide a new game that lets two players challenge each other using their reflexes and speed to grab the playing marker.

Even still another object of the present invention is to provide a new game that provides a portable game that is playable indoors and outdoors, and in confined and open spaces.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
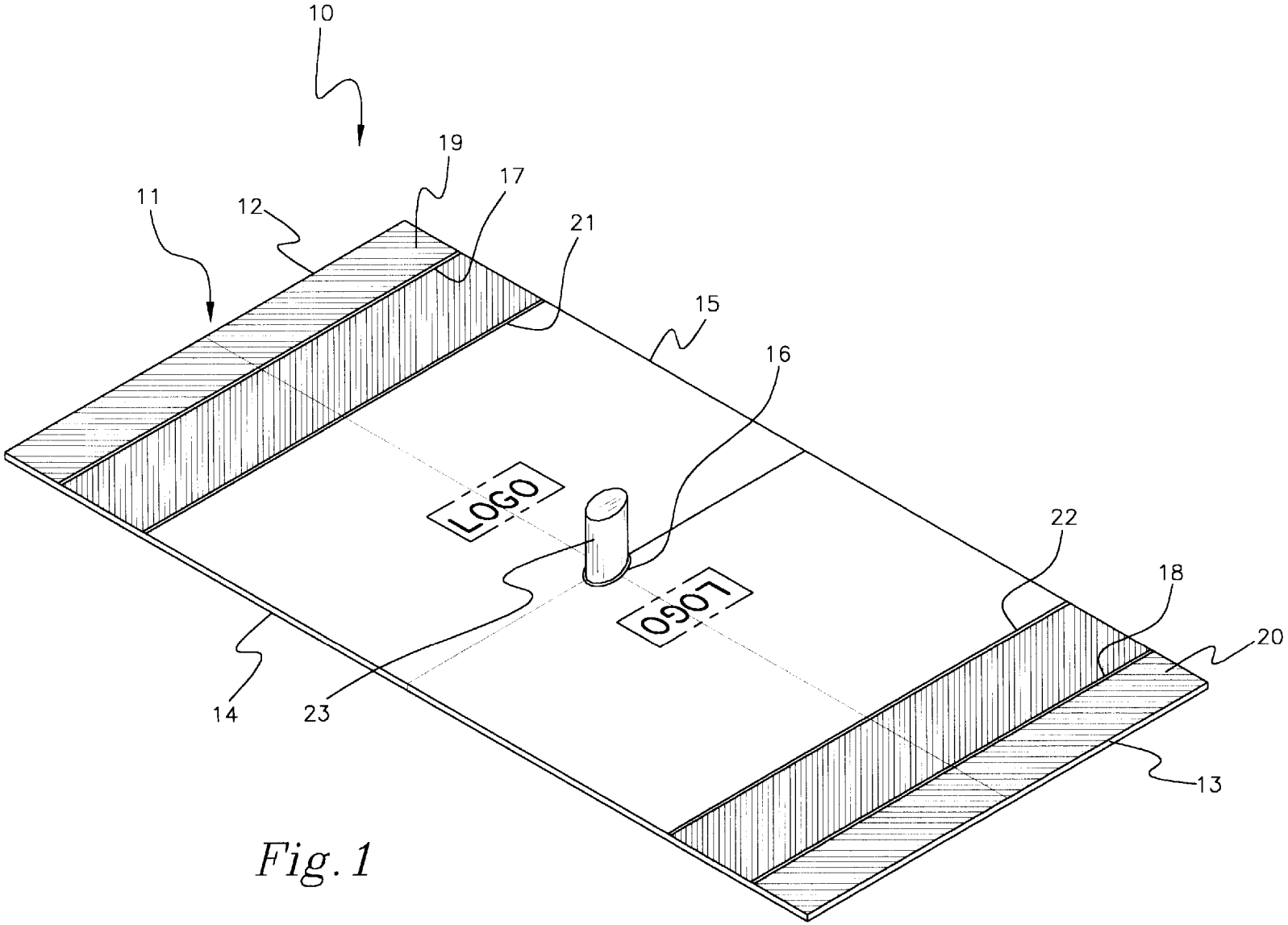
FIG. 1 is a schematic perspective view of a new game according to the present invention with the marker piece on the center point ready for a round to be played.
Figure 2:
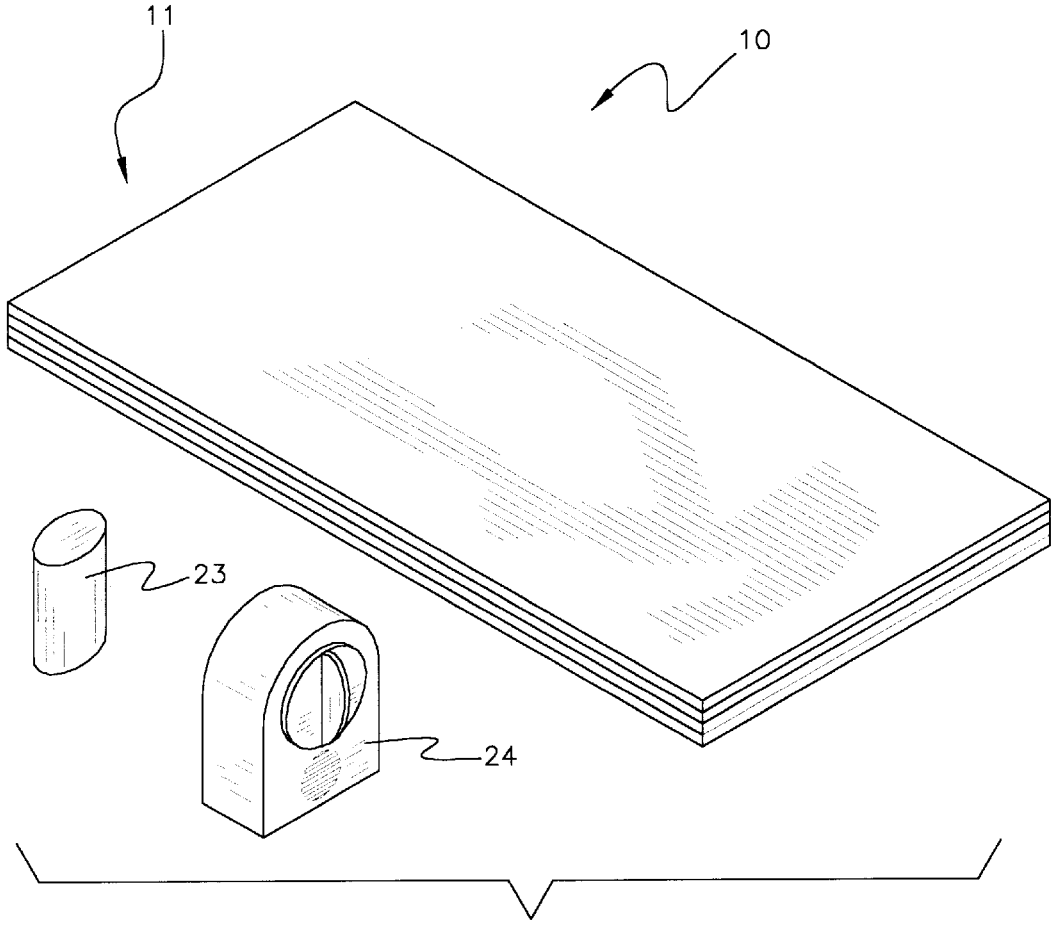
FIG. 2 is a schematic perspective view of the present invention with the optional buzzer device and the playing mat folded up.

With reference now to the drawings, and in particular to FIGS. 1 through 2 thereof, a new game embodying the principles and concepts of the present invention and generally designated by the reference numeral 10 will be described.

As best illustrated in FIGS. 1 through 2, the game 10 generally comprises a playing mat 11 with a pair of end edges 12,13 and a pair of side edges 14,15. The playing mat 11 also has a center point 16 and a pair of base lines 17,18 extending between the side edges 14,15 of the playing mat 11. The center point 16 is interposed between the base lines 17,18. Each of the base lines 17,18 defines a base region 19,20 extending from the respective base line and an adjacent associated end edge of the playing mat 11. resting the playing mat 11. A marker piece 23 is positioned on the center point 16 of the playing mat 11. A first player places a hand on the playing mat 11 in a first of the base regions 19 and a second player places a hand on the playing mat 11 in a second of the base regions 20. After a start command is issued the first and second players grab for the marker piece 23 with the player grabbing the marker piece 23 scoring a point.

In closer detail, the playing mat 11 is designed for placement on a surface. The playing mat 11 is generally rectangular and has a pair of generally straight end edges 12,13 and a pair of generally straight side edges 14,15 extending between the end edges 12,13 of the playing mat 11. The end edges 12,13 of the playing mat 11 extend generally parallel to one another. The side edges 14,15 of the playing mat 11 extend generally parallel to one another and generally perpendicular to the end edges 12,13 of the playing mat 11. The playing mat 11 has a length defined between the end edges 12,13 of the playing mat 11, and a width defined between the side edges 14,15 of the playing mat 11. Preferably, the length of the playing mat 11 is at least twice the width of the playing mat 11. In an ideal illustrative embodiment, the length of the playing mat 11 is about 30 inches and the width of the playing mat 11 is between about 15 and 20 inches. The player may ideally may be constructed from a material that permits folding of the playing mat for convenient storage and transport as illustrated in FIG. 2.

The playing mat 11 has a pair of generally parallel opposite base lines 17,18 extending between the side edges 14,15 of the playing mat 11 and generally parallel to the end edges 12,13 of the playing mat 11. One of the base lines 17 is positioned towards one of the end edges 12 of the playing mat 11 and another of the base lines 18 is positioned towards another of the end edges 13 of the playing mat 11. Each of the base lines 17,18 defines a generally rectangular base region 19,20 extending from the respective base line and the adjacent associated end edge of the playing mat 11.

The playing mat 11 also has a center point 16 positioned generally equidistant between the end edges 12,13 and the side edges 14,15 of the playing mat 11. Preferably, the center point 16 has a generally circular outer perimeter. The center point 16 is interposed between the base lines 17,18 with the base lines 17,18 about equally spaced apart from the center point 16. Optionally, the playing mat 11 may have a pair of generally parallel secondary base lines 21,22 for children extending between the side edges 14,15 of the playing mat 11 and generally parallel to the end edges 12,13 of the playing mat It. The secondary base lines 21,22 are interposed between the base lines 17,18 of the playing mat 11 while the center point 16 is interposed between the secondary base lines 21,22. The secondary base lines 21,22 are about equally spaced apart from the center point 16.

In use, the playing mat 11 is rested generally flat on a resting surface such as a floor or surface. The marker piece 23 is generally cylindrical or skittle shaped and ideally has a height greater than about 2 inches so that the marker piece can be grabbed by the hand of a player. The marker piece 23 is positioned on the center point 16 of the playing mat 11. A first player places a hand on the playing mat 11 in a first of the base regions 19. A second player places a hand on the playing mat 11 in a second of the base regions 20 with he first and second players facing one another. A start command is then issued and the first and second players grab for the marker piece 23. The player that grabs the marker piece 23 scores a point. The start command may be any vocal command such as the word "GO!" from a third person. Optionally, a buzzer device 24 may be provided for issuing the start command by emitting an audible buzzer sound as the start command. Dropping, knocking down and wrestling for the marker piece 23 after the start command is issued results in a no score and the marker piece is placed back on the center point with the first and second players returning their hands to their starting positions on the base regions.

The game 10 is based on a very simple idea: to be quicker than your opponent. The object of the game 10 is to grab the marker piece 23 before your opponent after a start command has been issued.

To play, two players face each other and place their arm in position on the gaming area. On a given command, the players try to grab the marker piece which is in the center point. When player achieves a clean grab or possession is achieved, a point is awarded to the player. The marker piece is then placed back in position on the center point and a new round is started. The best of three rounds decides the winner who may then stay and face a new challenger. If a clean grab is not achieved because of dropping, knocking down, or wrestling for the marker piece, the round is voided and a new round is started. If a player has a false grab, that is a grab before the start command is issued, the round is repeated after giving the players a short time to settle down. If the player commits a second consecutive false grab, the other player is then awarded a point.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of playing a game, comprising the steps of:

providing a playing mat being generally rectangular and having a pair of generally straight end edges and a pair of generally straight side edges extending between said end edges of said playing mat;

said end edges of said playing mat extending generally parallel to one another, said side edges of said playing mat extending generally parallel to one another and generally perpendicular to said end edges of said playing mat;

said playing mat having a length defined between said end edges of said playing mat, and a width defined between said side edges of said playing mat;

said length of said playing mat being at least twice said width of said playing mat;

said playing mat having a center point being positioned generally equidistant between said end edges and said side edges of said playing mat, said center point having a generally circular outer perimeter;

said playing mat having a pair of generally parallel opposite base lines extending between said side edges of said playing mat and generally parallel to said end edges of said playing mat, one of said base lines being positioned towards one of said end edges of said playing mat, another of said base lines being positioned towards another of said end edges of said playing mat;

each of said base lines defining a generally rectangular base region extending from the respective base line and the adjacent associated end edge of said playing mat;

said center point being interposed between said base lines, said base lines being about equally spaced apart from said center point;

wherein said playing mat has a pair of generally parallel secondary base lines extending between said side edges of said playing mat and generally parallel to said end edges of said playing mat; and said secondary base lines being interposed between said base lines of said playing mat, said center point being interposed between said secondary base lines, said secondary base lines being about equally spaced apart from said center point;

resting said playing mat on a resting surface;

providing a marker piece, said marker piece being generally cylindrical having a height greater than about 2 inches;

positioning said marker piece on said center point of said playing mat;

placing a hand of a first player on said playing mat in a first of said base regions;

placing the hand of a second player on said playing mat in a second of said base regions;

wherein said first and second players face one another; issuing a start command; providing a buzzer device is for issuing said start command; said first and second players grabbing for said marker piece; said player grabbing said marker piece scoring a point;

wherein dropping said marker piece after said start command is issued resulting in a no score;

wherein wresting by said first and second players for said marker piece after said start command is issued resulting in a no score; and wherein knocking said marker piece after said start command is issued resulting in a no score.

2. A method of playing a game, comprising the steps of:

providing a playing mat having a pair of end edges and a pair of side edges;

said playing mat having a center point;

said playing mat having a pair of base lines extending between said side edges of said playing mat, one of said base lines being positioned towards one of said end edges of said playing mat, another of said base lines being positioned towards another of said end edges of said playing mat;

each of said base lines defining a base region extending from the respective base line and the adjacent associated end edge of said playing mat; and said center point being interposed between said base lines; resting said playing mat;

providing a marker piece;

positioning said marker piece on said center point of said playing mat;

placing a hand of a first player on said playing mat in a first of said base regions;

placing the hand of a second player on said playing mat in a second of said base regions;

issuing a start command; and said first and second players grabbing for said marker piece, the player grabbing said marker piece scoring a point.

3. The method of claim 2, wherein said end edges of said playing mat extend generally parallel to one another, said side edges of said playing mat extend generally parallel to one another and generally perpendicular to said end edges of said playing mat.

4. The method of claim 3, wherein said playing mat has a length defined between said end edges of said playing mat, and a width defined between said side edges of said playing mat, wherein said length of said playing mat is at least twice said width of said playing mat.

5. The method of claim 2, wherein said center point has a generally circular outer perimeter.

6. The method of claim 2, wherein said base lines are about equally spaced apart from said center point.

7. The method of claim 2, wherein said playing mat has a pair of generally parallel secondary base lines extending between said side edges of said playing mat and generally parallel to said end edges of said playing mat, said secondary base lines being interposed between said base lines of said playing mat, said center point being interposed between said secondary base lines, said secondary base lines being about equally spaced apart from said center point.

8. The method of claim 2, wherein said marker piece is generally cylindrical has a height greater than about 2 inches.

9. The method of claim 2, further comprising the step of facing said first and second players towards each other.

10. The method of claim 2, wherein said start command is a vocal command from a third person.

11. The method of claim 2, further comprising the step of providing a buzzer device is for issuing said start command.

12. The method of claim 2, wherein dropping said marker piece after said start command is issued resulting in a no score, wherein wresting by said first and second players for said marker piece after said start command is issued resulting in a no score, and wherein knocking said marker piece after said start command is issued resulting in a no score.

* * * * *